United States Patent [19]

Fox

[11] 4,072,390

[45] Feb. 7, 1978

[54] ELECTRICAL CONNECTOR

[75] Inventor: Roy W. Fox, 4 Juniper Circle, Canton, Conn. 06019

[73] Assignee: Roy W. Fox, Canton, Conn.

[21] Appl. No.: 721,768

[22] Filed: Sept. 9, 1976

[51] Int. Cl.[2] ..... H01R 23/02

[52] U.S. Cl. ..... 339/176 MF

[58] Field of Search ..... 339/154 R, 154 A, 155 R, 339/156 R, 176 M, 176 MF

[56] References Cited

U.S. PATENT DOCUMENTS

| | | | |
|---|---|---|---|
| 2,860,314 | 11/1958 | Daniels et al. | 339/156 R |
| 3,378,808 | 4/1968 | French | 339/176 MF |
| 3,737,833 | 6/1973 | Jerominek | 339/17 F |

FOREIGN PATENT DOCUMENTS

| | | | |
|---|---|---|---|
| 1,217,899 | 5/1960 | France | 339/176 M |
| 584,989 | 9/1933 | Germany | 339/176 M |

*Primary Examiner*—Gerald A. Dost
*Attorney, Agent, or Firm*—Radford W. Luther

[57] ABSTRACT

An electrical connector for ribbon cable terminals has first and second longitudinally sets of conductor pins embedded in a block of insulating material. Each pin has a first end portion and a second end portion, the axes of which are in spaced parallel relationship, and a bent intermediate portion. On each side of the block a row of first end portions and a parallel spaced row of second end portions are defined. The intermediate portions on the pins of one set respectively cross the intermediate portions of the other set in the block without making contact. The connector is adapted to interconnect the terminals for diagnostic purposes, including Alpha continuity checks, as well as permitting connection of series or cascades of such terminals without the need for modifying cable terminations.

3 Claims, 8 Drawing Figures

ELECTRICAL CONNECTOR

BACKGROUND OF THE INVENTION

This invention relates to electrical and optical connectors, and more particularly to connectors for ribbon cable terminals.

Heretofore, connectors for ribbon cable terminals adapted to cascade and to perform diagnostic functions have suffered from relative complexity and high cost. There is thus a need for a simple and low cost diagnostic and cascade connector.

SUMMARY OF THE INVENTION

The invention provides a cascade or diagnostic electrical or optical connector for interconnecting ribbon cable terminals which incorporates a plurality of substantially identical conductor pins embedded in a block of insulating material. The pins include first and second end portions having axes in spaced parallel relationship and a bent intermediate portion so shaped that laterally adjacent pins may be arranged with their intermediate portions crossing within the block out of electrical contact. Such an arrangement achieves maximum utilization of space within the block which permits the necessary close lateral and longitudinal pin spacing.

A connector of the invention is extremely simple to manufacture since all of the conductor pins may be fashioned by the same dies. Moreover, the pins then need only be properly positioned and the insulating block formed therearound by injection molding.

Accordingly, it is a primary object of the invention to provide a cascade or diagnostic electrical connector for ribbon cable terminals which is simple in construction and easy to manufacture.

Another object is to provide an electrical connector for ribbon cable terminals in which a plurality of substantially identical specially shaped conductor pins are embedded within a block of insulating material in such a manner that the volume defined by the block may be efficiently utilized to closely space the pins without engendering contact therebetween.

These and other objects and advantages of the invention will become more readily apparent from the following detailed description, when taken in conjunction with the accompanying drawings, in which:

DETAILED DESCRIPTION OF PREFERRED EMBODIMENT

Figure 1:
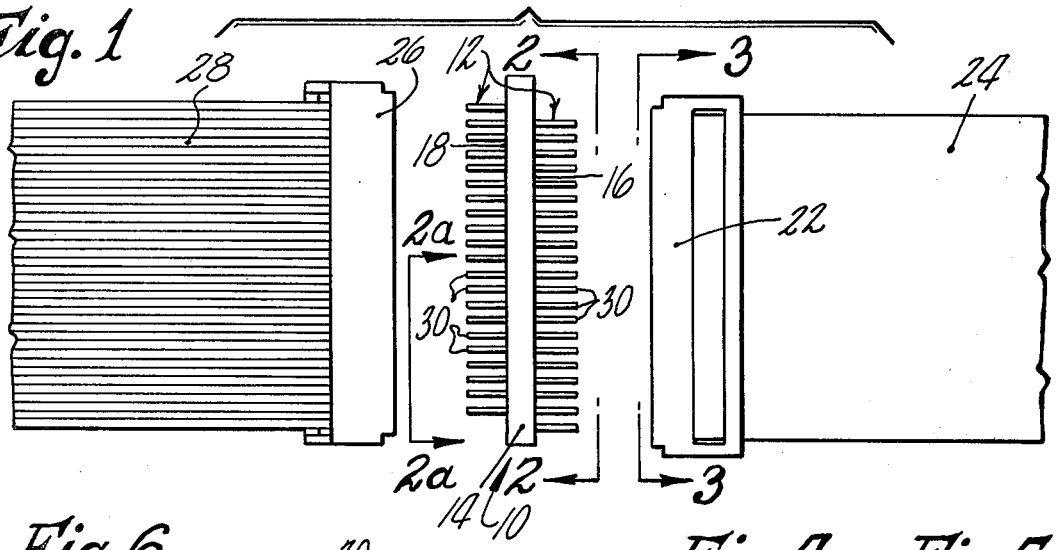
FIG. 1 is a top plan view showing an electrical connector of the invention in position to interconnect the terminals of two ribbon cables for a continuity check.

Referring now to the drawings, and more particularly to FIG. 1, there is shown a connector, generally indicated at 10. As depicted in FIG. 1, a plurality of conductor pins 12 project from both sides of a block of insulating material 14. The pins could be constituted by either electrical or optical conductors in accordance with the selected application.

Figure 2:
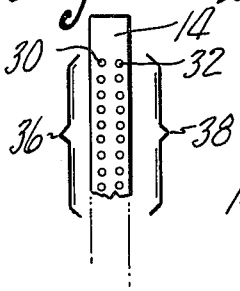
FIGS. 2 and 3 are side views of the electrical connector and a terminal, respectively, taken along the respective lines 2—2 and 3—3 of FIG. 1.

With reference to FIGS. 2, it will be seen that two spaced parallel rows of pins are formed on the right side 16 of the block 14 by laterally adjacent pairs longitudinally spaced along the longitudinal axis of the block. Similar rows of pins are provided on the left side 18 of the block 14. The pins projecting from the right side of the block 14 are adapted to respectively engage the sockets 20 in a ribbon cable terminal 22 which is connected to a ribbon cable 24. In like manner, the pins 12 projecting from the side 18 of the block 14 are adapted to respectively engage the sockets (not shown) in a ribbon cable terminal 26 connected to another ribbon cable 28.

Because of special geometric shape of the pins 12 and their orientation within the block 14, the upper row of pins projecting from the side 16 are respective electrically connected to the lower row of pins (not visible in FIG. 1) in projecting from the side 18. Similarly, the lower row or pins (not visible in FIG. 1) projecting from the side 16 are respectively electically connected to the upper row of pins projecting from the side 18. Hence, when the terminals and connector are engaged, the upper sockets in terminal 22 will be respectively connected to the lower of sockets in terminal 26. Of course, the lower sockets in terminal 22 will also be respectively connected to the upper sockets in terminal 26. It will therefore be appreciated that by orienting the terminals, as depicted in FIG. 1, with opposite surfaces of ribbon cable being displayed, alpha continuity can be effected when the connector 10 interconnects the terminals 22 and 26.

Figure 4:
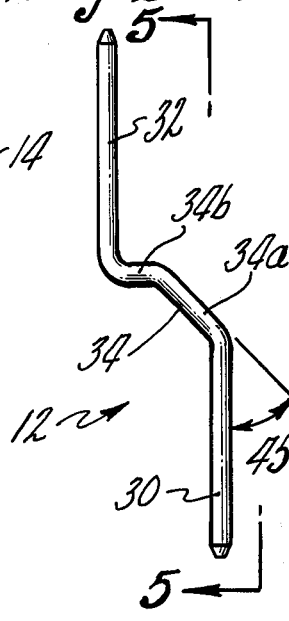
FIGS. 4 and 5 are respectively side and front views of a preferred conductor pin, per se, taken respectively along the line 4—4 of FIG. 5 and the line 5—5 of FIG. 4.
Figure 5:
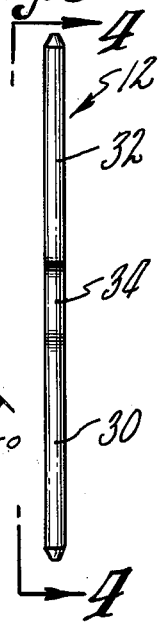
Figure 3:
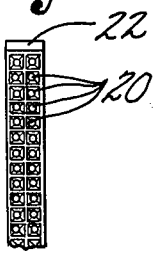

A preferred shape for the conductor pins, which are preferably identical, is shown in FIGS. 3 and 4. It will be appreciated that it is necessary to have specially shaped pins and a particular arrangement within the insulating block to include a large number of crossing pins within a small volume of insulating material. As illustrated in FIGS. 3 and 4, each pin 12 has a first end portion 30 and a second end portion 32 joined by a bent intermediate portion 34 which is embedded in the block. It will be noted that the axes of the end portions 30 and 32 are in spaced parallel relationship and that the axes of the end portions 30 and 32 and the axis of the intermediate portion 34 lie in a common plane. In addition, with respect to the intermediate portion, it can be seen that the axis thereof is comprised of a first segment **34*a* which forms acute angles with the axes of the first and second end portions 30 and 32 and of a second segment 34*b* which is orthogonal to the axes of the first and second end portions 30 and 32**.

Figure 6:
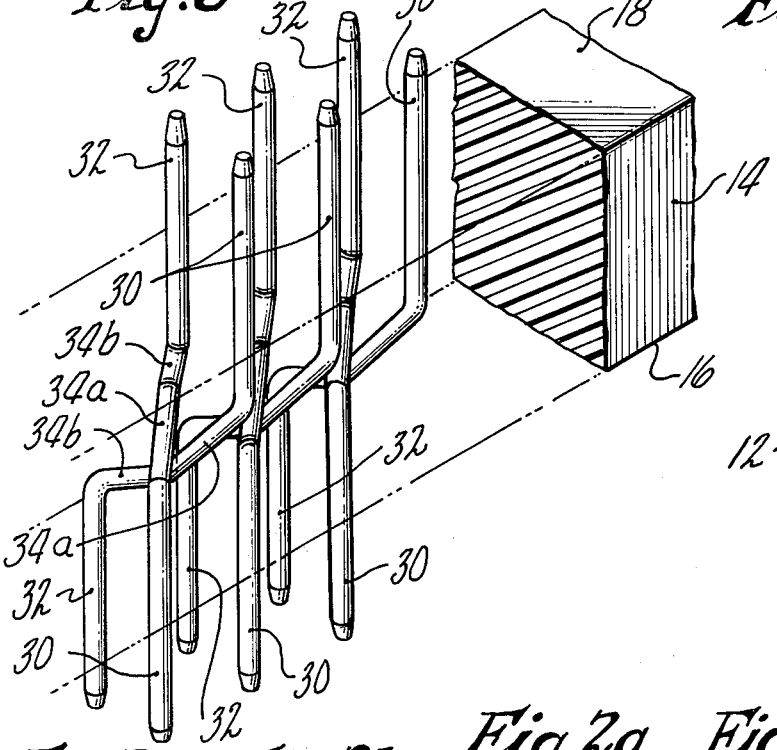
FIG. 6 is a fragmentary perspective view of the connector of FIG. 1 showing the arrangement of the conductor pins within the block.

Turning now to FIG. 6, with continued reference to FIG. 1, the arrangement of the pins with respect to the block 14 and to each other may best be appreciated. The pins are arranged in first and second longitudinally extending sets, designated 36 and 38, respectively, such that on each side of the block 14 two parallel rows of first end portions 30 and second end portions 32 are thereby defined. In addition, the arrangement of the pins in a given set is such that the planes defined by the axes of the pins therein are parallel and form an acute angle of about 45° with the axis of the block 14. It should also be mentioned that the planes of the pins of set 36 are orthogonal to the planes of the pins of set 38.

Figure 2B:
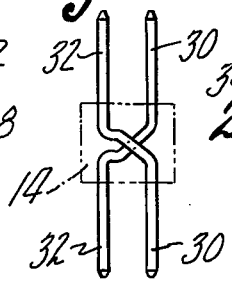
FIG. 2B is a front view of a pair of crossing conductor pins, taken along line 2B—2B of FIG. 2A.
Figure 2A:
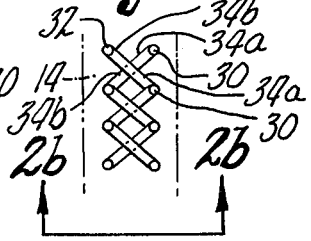
FIG. 2A is a side view of a pair of crossing conductor pins.

A study of FIG. 6 in concert with FIGS. 2A and 2B, will reveal the relationship between a pair of laterally adjacent pins. For example, it will be understood that the pins cross adjacent the respective junctures between axes 34*a* and 34*b* without making contact. Moreover, from FIG. 2A it can be seen that the first and second end portions of a laterally adjacent pair of conductor pins on one side of the block 14 are respectively axially aligned with the first and second end portions of the next longitudinally succeeding pair of conductor pins which project from the other side of the block. This alignment, although a matter of convenience in many applications, is not an essential attribute of the invention.

Other factors which should be noted are that the concept and its teachings may be applied to any wiring or fiber filament and is therefore equally useful for official or light transmitting circuitry.

From the foregoing, it will be appreciated that the invention provides an electrical connector which achieves maximum utilization of space, is simple in construction and readily lends itself to easy manufacture. In addition, such a connector could readily be incorporated in a suitable housing adapted to receive and retain two oppositely disposed terminals.

Obviously, many variations and modifications are possible in light of the above teachings without departing from the scope or spirit of the invention as defined in the subjoined claims. For example the intermediate portion 34 could be shaped as a continuous curve or the orthogonal elements could be in a cluster or circular pattern.

I claim:

1. An electrical connector for ribbon cable terminals comprising:

a block of insulating material having a longitudinal axis;

a plurality of substantially identical conductor pins, each having a first end portion projecting from a side of the block and a second end portion projecting from an opposite side of the block, the first end portion and second end portion of each pin being joined by a bent intermediate portion embedded in the block, each pin being shaped such that the respective axes of the first and second end portions thereof are in spaced parallel relationship and are disposed in a common plane with the axis of the intermediate portion therebetween, the pins being arranged in first and second longitudinally extending sets such that on each of the said sides of the block two parallel, laterally adjacent rows of first end portions and second end portions, respectively, are defined with each of the first end portions laterally adjacent a second end portion so as to form longitudinally spaced pairs of laterally adjacent pins and such that the respective planes defined by the pins in a set are parallel and form acute angles with the longitudinal axis of the block, the respective intermediate portions of a said pair or pins being in crossing relationship when viewed along the axis of the block.

2. An electrical connector, as defined in claim 1, wherein at least the first and second end portions of a pair of pins on the said one side of the block are respectively axailly aligned with the first and second end portions of another pair of pins on the said opposite side of the block.

3. An electrical connector, as defined in claim 1, wherein the axis of the intermediate portion of a pin comprises a first segment which forms acute angles with the axis of the first and second end portions thereof and a second segment which is orthogonal to the axes of first and second end portions thereof.

* * * * *